US005980128A

United States Patent [19]

Verlinden et al.

[11] Patent Number: 5,980,128

[45] Date of Patent: Nov. 9, 1999

[54] UNIT FOR THERMAL TREATMENT OF AN IMAGING ELEMENT FOLLOWING IMAGE EXPOSURE

[75] Inventors: Bart Verlinden, Tongeren; Patrick Van den Bergen, Hove; Joan Vermeersch, Deinze, all of Belgium

[73] Assignee: Agfa-Gevaert N.V., Mortsel, Belgium

[21] Appl. No.: 09/096,670

[22] Filed: Jun. 12, 1998

Related U.S. Application Data

[60] Provisional application No. 60/058,284, Sep. 9, 1997.

[51] Int. Cl.[6] ..... G03D 13/00

[52] U.S. Cl. ..... 396/575; 219/216

[58] Field of Search ..... 396/575; 355/27–29, 355/100, 400; 250/316.1, 317.1, 318, 319; 219/216; 399/320, 322, 326, 327, 330, 335, 336, 337, 338

[56] References Cited

U.S. PATENT DOCUMENTS

| | | | |
|---|---|---|---|
| 3,864,709 | 2/1975 | Bruns | 396/575 |
| 4,711,549 | 12/1987 | Roodbeen | 219/216 |
| 5,289,248 | 2/1994 | Kirokawa | 355/285 |
| 5,669,032 | 9/1997 | Islam et al. | 396/575 |

FOREIGN PATENT DOCUMENTS

| | | |
|---|---|---|
| 0290245 | of 0000 | European Pat. Off. . |
| 0469735 | of 0000 | European Pat. Off. . |
| 3137430 | of 0000 | Germany . |

*Primary Examiner*—D. Rutledge
*Attorney, Agent, or Firm*—Baker & Botts, L.L.P.

[57] ABSTRACT

The thermal treatment unit comprises a housing (12) having an inlet (14) and an outlet (16) for the imaging element so positioned as to define a path (18) through the housing (12). A continuous surface (20), formed of heat conductive material, is positioned on one side of the path (18). Drive means (22) move the continuous surface (20) in synchronism with the imaging element (10) as it passes through the housing (12). The imaging element (10) is urged into heat conductive contact with the continuous surface (20) and a heat source (26) is provided on the far side of the continuous surface from the path. A more even transfer of heat to the imaging element (10) is thereby achieved.

8 Claims, 3 Drawing Sheets

UNIT FOR THERMAL TREATMENT OF AN IMAGING ELEMENT FOLLOWING IMAGE EXPOSURE

The application claims the benefit of U.S. Provisional Application Ser. No. 60/058,284 filed Sep. 9, 1997.

DESCRIPTION

Field of the Invention

The present invention relates to a thermal treatment unit for thermal treatment an imaging element following image exposure.

BACKGROUND OF INVENTION

Lithographic printing plates are known carrying a light sensitive emulsion which, after exposure, is subjected to a baking or "burning-in" process. A baking unit for baking such a lithographic printing plate following image exposure is known, for example from International patent application U.S. Pat. No. 5,166,523, European patent application EP 290245-A, German patent application DE3137430-A and WO 90/02974, comprising a housing having an inlet and an outlet for the printing plate so positioned as to define a path through the housing. A continuous surface such as a belt is positioned on one side of the path and is driven in synchronism with the plate material as it passes through the housing. The plate is urged against the continuous surface and a heat source is provided to heat the continuous surface.

Such devices can also be used for photo-thermographic processes. These are processes wherein latent images are generated by the image-wise exposure of a recording material to UV, visible or infrared radiation followed by development by uniformly heating the exposed recording material to a desired development temperature, thereby creating a visible image. Examples of photo-thermographic materials include the so-called "Dry Silver" photographic materials of the 3M company, which are reviewed by D A Morgan in "Handbook of Imaging Science", edited by A Diamond, published by Marcel Dekker Inc., New York, 1991, page 43.

Such known thermal treatment devices tend to result in non-uniform thermal treatment temperatures. Uneven heating is particularly a problem with imaging elements having a non-heat conductive base, such as a polymer material. When radiant heat is used and the plate carries images of different colours, differential heat absorption can result in non-uniform heating.

OBJECTS OF INVENTION

It is an object of the present invention to provide a thermal treatment device in which more uniform heat transfer to the imaging element can be achieved.

SUMMARY OF THE INVENTION

We have discovered that this objective and other useful benefits can be achieved when the continuous surface is formed of heat conductive material, the imaging element is urged into heat conductive contact with the continuous surface and the heat source is provided on the far side of the continuous surface from the path.

Thus, according to a first aspect of the invention, there is provided a thermal treatment unit for thermal treatment an imaging element following image exposure, the thermal treatment unit comprising:

a housing having an inlet and an outlet for the imaging element so positioned as to define a path through the housing;

a continuous surface formed of heat conductive material positioned on one side of the path;

surface drive means for moving the continuous surface in synchronism with the imaging element as it passes through the housing;

means positioned on the opposite side of the path to urge the imaging element into heat conductive contact with the continuous surface; and a heat source provided on the far side of the continuous surface from the path to heat the continuous surface.

The thermal treatment unit may further comprise drive means to drive an imaging element along the path through the housing, although it is also possible for drive means to be provided outside the unit, especially where the path length through the unit is shorter than the length of the imaging element. The drive means may be constituted by the continuous surface.

The invention also provides a method of thermal treatment an imaging element following image exposure, comprising:

driving the imaging element along a path;

moving a continuous surface formed of heat conductive material positioned on one side of a path in synchronism with the imaging element as it passes along the path;

urging the imaging element into heat-conductive contact with the continuous surface; and heating the continuous surface from the far side thereof from the path.

The urging means may include a set of nozzles to direct optionally heated air onto the imaging element as it passes along the path so that the method includes directing heated air onto the imaging element as it passes along the path. Other possible urging means include one or more rotating brushes or a second belt positioned on the far side of the path and urged into contact with the first belt to form a contact zone there-between.

The heat conductive continuous surface may be formed of chrome-nickel plate and is preferably provided with a non-stick surface covering, for example comprising a material selected from polytetrafluoroethylene and fluorinated nickel such as NiFluor (ex Kannigen, Belgium), preferably having a thickness of from 1 $\mu$m to 10 $\mu$m.

A cleaning device such as a scraper or brush may be provided for removing any debris that may form thereon, which might otherwise disturb the thermal treatment of subsequent imaging elements.

The heat source may comprise a thermal mass in heat conductive contact with the continuous surface on the opposite side thereof from the path to spread the heat evenly across the width of the imaging element. The continuous surface is preferably the surface of a belt and the thermal mass is a stationary thermal mass in contact with the belt. The belt may have a thickness of from 25 $\mu$m to 500 $\mu$m. With thicker belts, it is possible that the belt itself will constitute the thermal mass. Alternatively, the continuous surface is the surface of a drum and the thermal mass is constituted by the bulk of the drum.

The continuous surface is preferably heated by a method selected from conduction, induction (where the continuous surface is constituted by magnetic belt), radiation, convection, and combinations thereof. The continuous surface is preferably heated to a temperature of from 45° to 280° C., most preferably from 45° to 90° C. in the case of photo-thermography, and from 130° to 280° C. in the case of burning-in lithographic printing plates. The imaging element is preferably in contact with the continuous surface for a period of from 10 seconds to 2 minutes. The nozzles may be arranged to direct air at a temperature of from room temperature or below to 280° C. towards the imaging element at a speed of from 2 to 10 m/s. A lower temperature within this range is preferred for maintaining the thermal stability of the imaging element. The heat contact between the thermal mass and the continuous surface may not be direct contact, but may be via an intermediate area filled, for example, with heat conductive paste.

Ideally, the path is substantially straight.

In a preferred embodiment of the invention, the continuous surface is a first continuous surface and a second continuous surface formed of heat conductive material is positioned on the other side of the path downstream of the first continuous surface, second surface drive means are provided for moving the second continuous surface in synchronism with the imaging element as it passes along the path, second urging means are provided to urge the imaging element into heat conductive contact with the second continuous surface; and a second heat source is provided on the far side of the second continuous surface from the path to heat the second continuous surface as it passes. The second urging means may includes a second set of nozzles positioned on the opposite side of the path to direct heated air on to the imaging element as it passes along the path.

The imaging element is typically of the type which is in sheet form having an emulsion coating on one face thereof, which face contacts the continuous surface as the imaging element passes along the path. The sheet may have a thickness of from 50 μm to 500 μm. Usually, the sheet comprises a base formed of a material selected from aluminium, glass, a plastics material and combinations thereof.

DETAILED DESCRIPTION OF THE INVENTION

The invention will be described by the following illustrative embodiments with reference to the accompanying drawings without the intention to limit the invention thereto, and in which.

Figure 1:
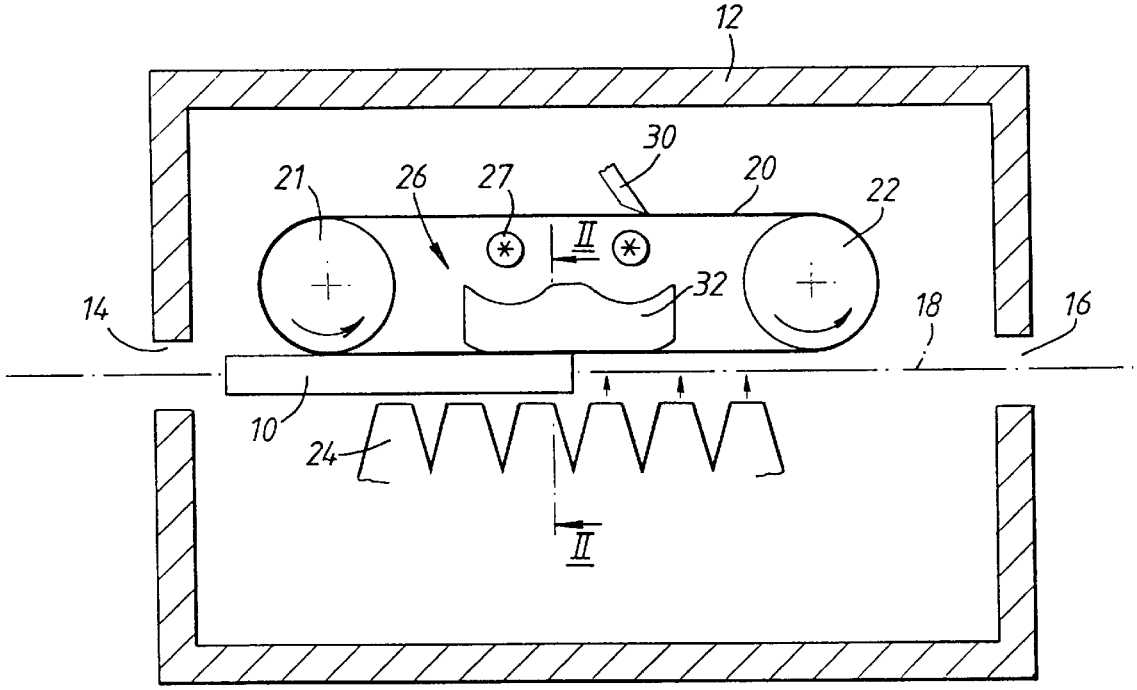
FIG. 1 is a diagrammatical representation of a thermal treatment oven according to the invention.
Figure 2:
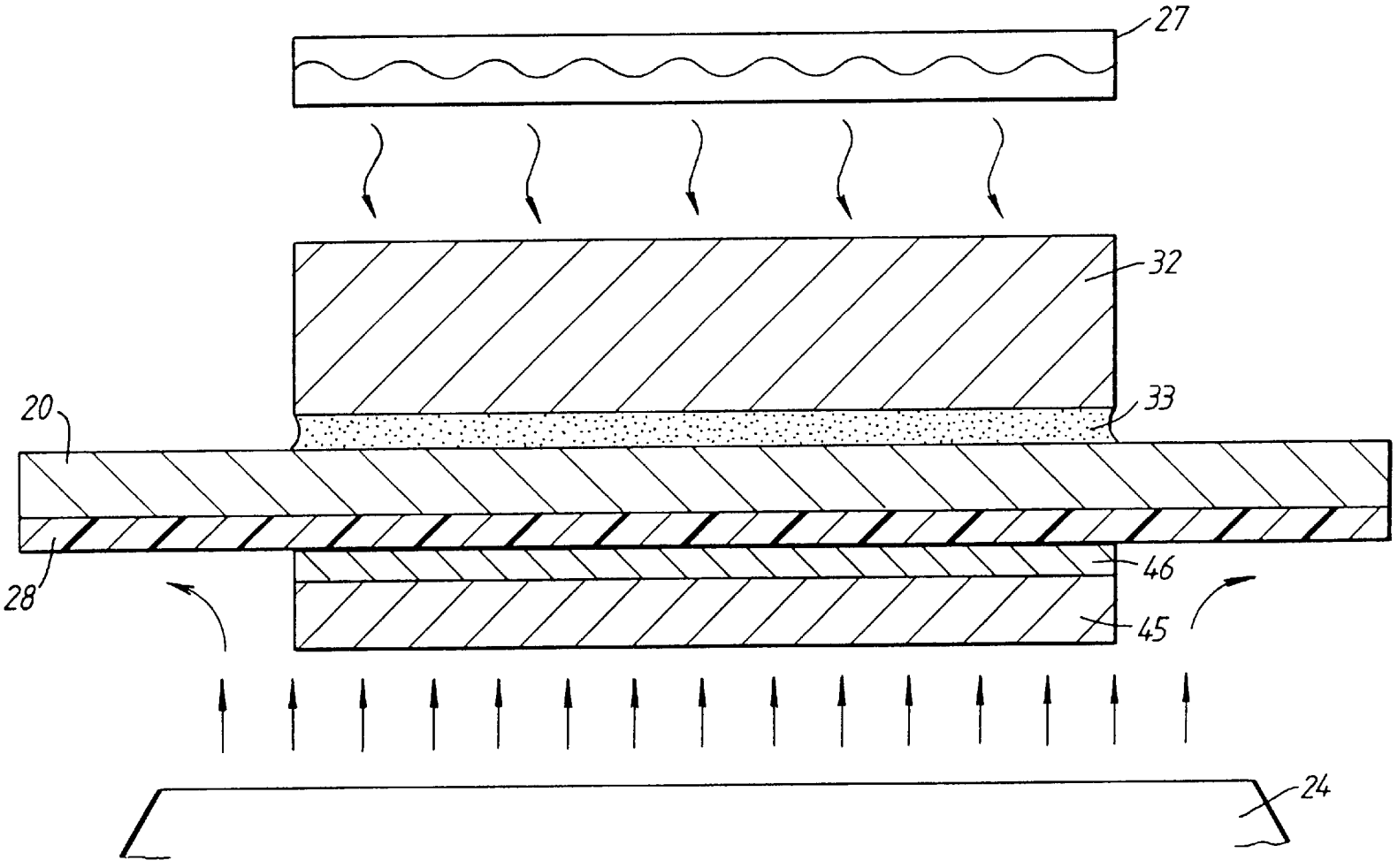
FIG. 2 is an enlarged section taken on the line II—II in FIG. 1.

As shown in FIGS. 1 and 2 a thermal treatment unit for thermal treatment of a lithographic printing plate or other imaging element following image exposure comprises a generally closed housing 12 having a sheet material inlet 14 and a sheet material outlet 16 so positioned as to define a substantially straight path 18 extending through the housing 12.

An impermeable belt 20 formed of chrome-nickel is positioned on one side of the path 18, downstream of the inlet 14. The belt has a thickness of from approximately 250 μm and is optionally provided with a non-stick surface 28 covering, comprising polytetrafluoroethylene having a thickness of from about 5 μm. The belt passes over a freely rotating belt guide roller 21, and a driven roller 22. A cleaning device such as a scraper 30 is provided for the belt 20 to remove any debris therefrom.

A set of nozzles 24 are positioned on the opposite side of the path 18 to direct air onto a lithographic printing plate 10 as it passes along the path 18 to urge the plate 10 into heat conductive contact with the belt 20. As it passes through the housing 12, the plate therefore moves in synchronism with the belt 20. The nozzles are supplied with air at room temperature towards the plate at a speed of 6 m/s.

The plate 10 is typically of the type which comprises a base 45 formed of aluminium, glass, a heat resistant plastics material or combinations thereof having an emulsion coating 46 on one face thereof, which face contacts the belt 20 as the lithographic printing plate 10 passes along the path 18. The plate 10 may have a thickness of from 75 μm to 500 μm.

A heat source 26 is provided on the far side of the belt 20 from the path 18 to heat the belt 20. The heat source 26 includes a stationary thermal mass 32, formed for example of aluminum, heated by a number of radiant heaters 27. The thermal mass is in heat conductive contact with the belt 20 on the opposite side thereof from the path 18 via an intermediate area filled with heat conductive copper/oil paste 33. The thermal mass 32 is so shaped in relation to the position and number of radiant heaters 27 to ensure a generally uniform heat transfer to the belt 20. The belt 20 is thus heated by conduction through the thermal mass 32 to a temperature of, for example about 200° C. The speed of the plate 10 through the thermal treatment unit is such, for example, that the emulsion face of the plate 10 is in contact with the belt 20 for 1 minute.

Figure 3:
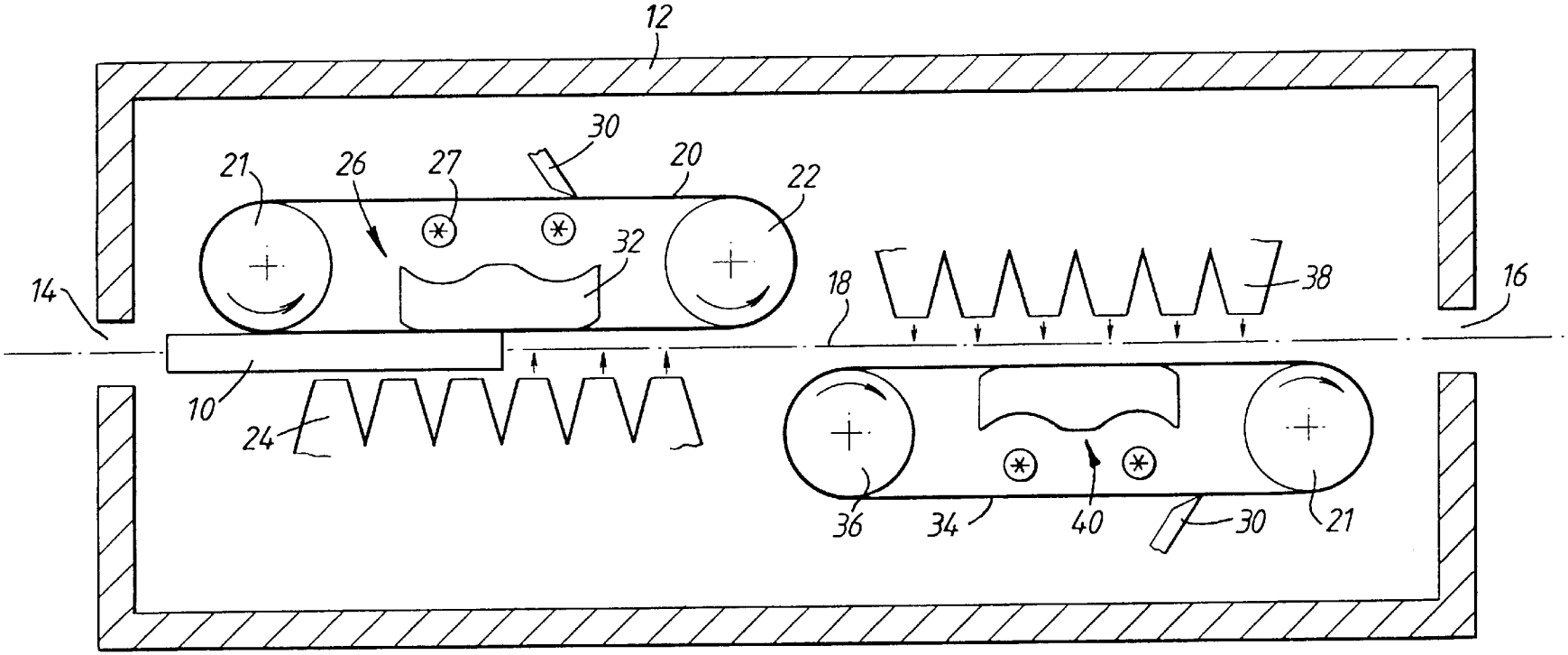
FIG. 3 is a view similar to FIG. 1, of a thermal treatment oven modified for use with imaging elements having emulsion coatings on both sides.

Referring to FIG. 3, which shows a thermal treatment over similar to that shown in FIG. 1, but modified for the treatment of imaging members having emulsion coatings on both faces, there is shown a second belt 34 formed in a similar manner to the first belt 20 is positioned on the other side of the path 18 downstream of the first belt 20 and is driven by a second driven roller 36 in synchronism with the plate 10 as it passes along the path 18.

A second the set of nozzles 38 direct air on to the plate 10 as it passes along the path 18 to urge the plate 10 into heat conductive contact with the second belt 34. A second heat source 40 is provided on the far side of the second belt 34 from the path 18 to heat the second belt 34 as it passes. The second heated belt 34 serves to bake the opposite face of the plate 10. This is beneficial when the plate includes a heat conductive base and/or when the plate carries an emulsion on both faces thereof. In the case of single sided coated plates, the heating of the second belt 34 can be dispensed with, and air directed from the nozzles 38 may be unheated, the second belt 34 then serving merely to transport the plate towards the exit 16.

REFERENCE NUMBER LIST housing 12
inlet 14
outlet 16
path 18
belt 20
guide roller 21
driven roller 22
nozzles 24
heat source 26
radiant heaters 27
non-stick surface 28
scraper 30
thermal mass 32
heat conductive paste 33
second belt 34
second driven roller 36
second the set of nozzles 38 second heat source 40
base 45
coating 46

We claim:

1. A thermal treatment unit for thermal treatment an imaging element (10) following image exposure, the thermal treatment unit comprising:

a housing (12) having an inlet (14) and an outlet (16) for said imaging element so positioned as to define a path (18) through said housing (12);

a continuous surface (20) formed of heat conductive material positioned on one side of the path (18);

surface drive means (22) for moving said continuous surface (20) in synchronism with said imaging element (10) as it passes through said housing (12);

urging means (24) positioned on the opposite side of said path (18) to urge said imaging element (10) into heat conductive contact with said continuous surface (20); and a heat source (26) provided on the far side of said continuous surface (20) from said path (18) to heat said continuous surface (20), wherein said urging means includes a set of nozzles (24) to direct air onto said imaging element (10) as it passes along said path (18).

2. A thermal treatment unit according to claim 1, wherein said continuous surface (20) is provided with a non-stick surface (28) covering.

3. A thermal treatment unit according to claim 1, further comprising a cleaning device (30) for said continuous surface (20).

4. A thermal treatment unit according to claim 1, wherein said heat source (26) comprises a thermal mass (32) in heat conductive contact with said continuous surface (20) on the opposite side thereof from said path (18).

5. A thermal treatment unit according to claim 1, wherein said path (18) is substantially straight.

6. A thermal treatment unit according to claim 1, wherein said continuous surface (20) is a first continuous surface (20) and a second continuous surface (34) formed of heat conductive material is positioned on the other side of said path (18) downstream of said first continuous surface (20), second surface drive means (36) are provided for moving said second continuous surface (34) in synchronism with said imaging element (10) as it passes along said path (18), second urging means (38) are provided to urge said imaging element (10) material into heat conductive contact with said second continuous surface (34); and a second heat source (40) is provided on the far side of said second continuous surface (34) from said path (18) to heat said second continuous surface (34) as it passes.

7. A method for the thermal treatment of an imaging element (10) following image exposure, comprising:

driving said imaging element (10) along a path (18);

moving a continuous surface (20) formed of heat conductive material positioned on one side of a path (18) in synchronism with said imaging element (10) as it passes along said path (18);

directing heated air onto said imaging element (10) as it passes along said path (18);

urging said imaging element (10) into heat-conductive contact with said continuous surface (20); and heating said continuous surface (20) from the far side thereof from said path (18).

8. A method according to claim 7, wherein said imaging element (10) has an emulsion coating on one face thereof, which face contacts said continuous surface (20) as the imaging element (10) passes along said path (18).

* * * * *

UNITED STATES PATENT AND TRADEMARK OFFICE

CERTIFICATE OF CORRECTION

PATENT NO. : 5,980,128

DATED : November 9, 1999

INVENTOR(S) : Verlinden et al.

It is certified that error appears in the above-identified patent and that said Letters Patent is hereby corrected as shown below:

Title Page, Item [30] Foreign Application Priority Data:Insert
-- [30] Foreign Application Priority Data
Jul. 27, 1997 [EP] European Pat. Off. ..... 97202382.4 --.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*